US008500036B2

(12) United States Patent
Venkataraghavan et al.

(10) Patent No.: US 8,500,036 B2
(45) Date of Patent: Aug. 6, 2013

(54) HYDRAULICALLY AMPLIFIED MECHANICAL COUPLING

(75) Inventors: Jay Venkataraghavan, Dunlap, IL (US); Alan R. Stockner, Metamora, IL (US)

(73) Assignee: Caterpillar Inc., Peoria, IL (US)

( * ) Notice: Subject to any disclaimer, the term of this patent is extended or adjusted under 35 U.S.C. 154(b) by 612 days.

(21) Appl. No.: 12/776,203

(22) Filed: May 7, 2010

(65) Prior Publication Data

US 2011/0272499 A1 Nov. 10, 2011

(51) Int. Cl.
*F02D 1/06* (2006.01)

(52) U.S. Cl.
USPC ..... 239/5; 239/88; 239/96; 239/102.2; 239/124; 239/533.4

(58) Field of Classification Search
USPC ..... 239/5, 102.2, 124, 127, 96, 533.4, 239/584, 88–90; 251/129.06
See application file for complete search history.

(56) References Cited

U.S. PATENT DOCUMENTS

| | | | | |
|---|---|---|---|---|
| 3,753,426 | A | 8/1973 | Lilley | |
| 4,584,980 | A | 4/1986 | Weiger et al. | |
| 5,697,554 | A | 12/1997 | Auwaerter et al. | |
| 5,779,149 | A | 7/1998 | Hayes, Jr. | |
| 5,833,142 | A | 11/1998 | Caley | |
| 6,062,489 | A * | 5/2000 | Tokumaru | 239/124 |
| 6,502,803 | B1 | 1/2003 | Mattes | |
| 6,588,678 | B1 | 7/2003 | Mattes | |
| 6,719,264 | B2 * | 4/2004 | Mattes | 239/102.2 |
| 7,100,577 | B2 | 9/2006 | Mumford et al. | |
| 7,140,353 | B1 | 11/2006 | Rauznitz et al. | |
| 7,258,283 | B2 | 8/2007 | Heinz et al. | |
| 2004/0149840 | A1 | 8/2004 | Remmels et al. | |
| 2005/0274360 | A1 | 12/2005 | Mumford et al. | |

FOREIGN PATENT DOCUMENTS

| | | |
|---|---|---|
| EP | 1174615 | 1/2002 |
| JP | 2002202022 | 7/2002 |
| JP | 2004204813 | 7/2004 |
| JP | 2007107417 | 4/2007 |

* cited by examiner

*Primary Examiner* — Steven J Ganey
(74) *Attorney, Agent, or Firm* — Leydig, Voit & Mayer

(57) ABSTRACT

A component includes a transmission arrangement for transmitting a force between an actuator and a control valve. The transmission arrangement includes a post that is associated with the actuator. The control valve is displaceable to an open position from a closed position when an opening force is applied to the control valve that is greater than a closing force provided to the control valve. The transmission arrangement is disposed in the component between the post and the control valve actuator and arranged to mechanically transmit by physical contact an actuator force from the post to the control valve when the post begins to travel towards the extended stroke position, and hydraulically amplify the actuator stroke between the post and the control valve when the post travels from the retracted stroke position to the extended stroke position.

17 Claims, 5 Drawing Sheets

HYDRAULICALLY AMPLIFIED MECHANICAL COUPLING

TECHNICAL FIELD

This patent disclosure relates generally to actuators for use with various components and systems, such as internal combustion engines, and, more particularly to a mechanical coupling having hydraulic amplification for transmitting a force and/or displacement of the actuator to a controlled element of the component or system.

BACKGROUND

Fuel injectors having piezoelectric actuators are known and are used in various applications. A typical piezoelectric actuator arrangement is made of a stack of piezoelectric material wafers. When exposed to an electrical field, the piezoelectric material in the actuator undergoes a physical dimension change, which causes an overall extension of the actuator. The displacement caused by the extension of the actuator is used to actuate internal components of the system in which it is arranged, for example, a fuel injector during an injection event.

Although piezoelectric actuators can yield relatively high actuation force when activated, the magnitude of the actuator force decreases dramatically as the displacement or stroke of the actuator increases. For example, although a typical piezoelectric actuator may be capable of producing 2 kN of force at the beginning of its stroke, its force output may decrease during its stroke and be zero at a stroke of about 40 μm. Thus, fuel injectors having mechanical couplings to transfer the actuator displacement to other portions of the fuel injector may lack sufficient actuation stroke or lack sufficient force for larger strokes. As can be appreciated, although the high force over a small displacement may be sufficient for a particular fuel injector application, its general applicability depends on the arrangement of the components to be displaced under the force of the actuator. For example, in fuel injectors, which is a common application for such actuators, the force of the actuator over its stroke may be sufficient for relatively smaller fuel injectors, or fuel injectors operating at relatively low fuel pressures, such as those used in engines with smaller displacements. However, it may be unsuitable for applications requiring larger fuel injectors or fuel injectors operating at relatively high fuel pressures.

Because of the need to increase the force of piezoelectric actuators over longer strokes, or alternatively the need to increase the forceful stroke of such actuators, known applications have used hydraulic amplification arrangements. For purpose of discussion, and in keeping with the discussion relative to fuel injectors, one example of a hydraulic amplification for a fuel injector can be found in the description of U.S. Pat. No. 5,697,554, which is titled "Metering Valve for Metering a Fluid," and which issued on Dec. 16, 1997 ("the '554 patent"). The '554 patent discloses a fuel injector that includes a needle valve arranged to selectively open fluid passages through which fuel may be delivered into the power cylinder of an internal combustion engine. Operation of the needle valve is controlled by a piezoelectric actuator. As described in the '554 patent, a hydraulic displacement amplifier is disposed between the piezoelectric actuator and the needle valve for converting the actuating displacement of the actuator into an increased stroke of the needle valve.

Hydraulic amplification of the stroke of a piezoelectric actuator is a commonly used arrangement that can increase the effective stoke of a piezoelectric actuator. In general, hydraulic amplification in a fuel injector involves providing two hydraulic piston bores of different cross sectional areas that are fluidly connected to one another within the fuel injector. A larger plunger disposed in the larger of the two bores is typically mechanically connected to the piezoelectric actuator, and a smaller plunger disposed in the smaller of the two bores is connected to those components of the fuel injector that are actuated. During operation, an incompressible fluid is provided within the bores such that a relatively small displacement of the piezoelectric actuator causes motion of the larger plunger that compresses the fluid within the bores. The compressed fluid thus pushes on the smaller plunger to effect actuation of the fuel injector components. Because of the different cross section between the two bores, the displacement of the larger plunger is amplified at the smaller plunger.

Although hydraulic amplification can effectively increase the powered stroke of a piezoelectric actuator, the force provided by the actuator over the increased stroke is reduced. Additionally, hydraulic amplification arrangements may lack sufficient force at the initial portion of the stroke to open fuel injector valves in applications using relatively high injection pressures. Further, insofar as its essential components require precise machining of complicated features and subcomponents of the injector, the durability of the fuel injector may be compromised and the cost of the fuel injector may be increased.

SUMMARY

This disclosure relates to structural arrangements for piezoelectric actuators that realize the advantages of high initial power and low response time that were previously only associated with mechanical coupling arrangements. Such known mechanical arrangements, however, lacked sufficient actuator stroke. In addition to the desirable mechanical coupling characteristics, the disclosed structural arrangements are further capable of providing increased actuator stroke capability, which was previously only achievable by hydraulic stroke amplification arrangements. All such advantages are realized without the disadvantages commonly associated with known mechanical coupling or hydraulic stroke amplification arrangements alone.

The disclosure describes, in one aspect, a transmission arrangement for transmitting force and/or displacement between an actuator and a controlled element. In one disclosed embodiment, a component includes the transmission arrangement for transmitting a force between an actuator and a control valve. The transmission arrangement includes a post that is associated with the actuator. The control valve is displaceable to an open position from a closed position when an opening force is applied to the control valve that is greater than a closing force provided to the control valve. The transmission arrangement is disposed in the component between the post and the control valve actuator and arranged to mechanically transmit, by physical contact, an actuator force from the post to the control valve when the post begins to travel towards the extended stroke position, and hydraulically amplify the actuator stroke between the post and the control valve when the post travels from the retracted stroke position to the extended stroke position.

In another aspect, the disclosure describes a fuel injector for an internal combustion engine. The fuel injector includes an injector body that houses an actuator having a post disposed within the injector body. The post is arranged to travel over an actuator stroke between an extended stroke position when the actuator is in an activated condition and a retracted stroke position when the actuator is in a deactivated condition. A control valve disposed within the housing is moved to an open position from a closed position when an opening force is applied to the control valve that is greater than a closing force provided to the control valve. The transmission arrangement is arranged to mechanically transmit by physical contact an actuator force from the post to the control valve when the post begins to travel towards the extended stroke position, and thereafter hydraulically amplify the actuator stroke between the post and the control valve while the post continues to travel from the retracted stroke position to the extended stroke position.

In yet another aspect, the disclosure describes a method for operating a device by use of a mechanical coupling having a hydraulically assisted feature. The method includes activating an actuator included in a component. The actuator is arranged to extend a post by an actuator stroke distance between a retracted stroke position and an extended stroke position. A mechanical force is provided to a controlled element by physical contact between the actuator post and the controlled element, which may occur directly or via intervening components. The actuator stroke is amplified by providing a hydraulic force that is transmitted by compression of fluid within a bore between an intensifier piston, which is in contact with the post of the actuator, and an amplification piston, which is arranged to transfer the amplified actuator stroke to the controlled element.

DETAILED DESCRIPTION

In the description that follows, although a fuel injector for use in an internal combustion engine is used for purpose of illustration, it should be appreciated that the structures and methods recited herein are applicable to other devices or systems using piezoelectric actuators, such as electromechanical valves, and others.

Figure 1:
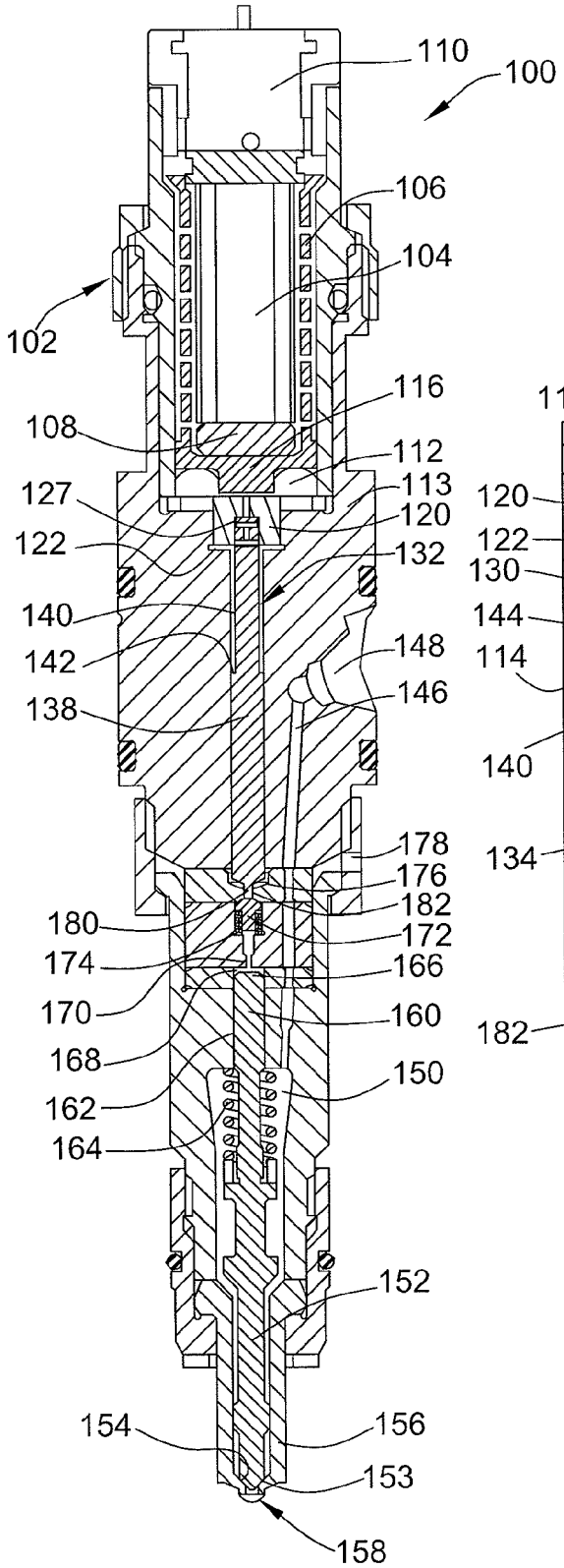
FIGS. 1 and 2 are cross sections of a hydraulically amplified mechanical coupling for a fuel injector in accordance with the disclosure.
Figure 2:
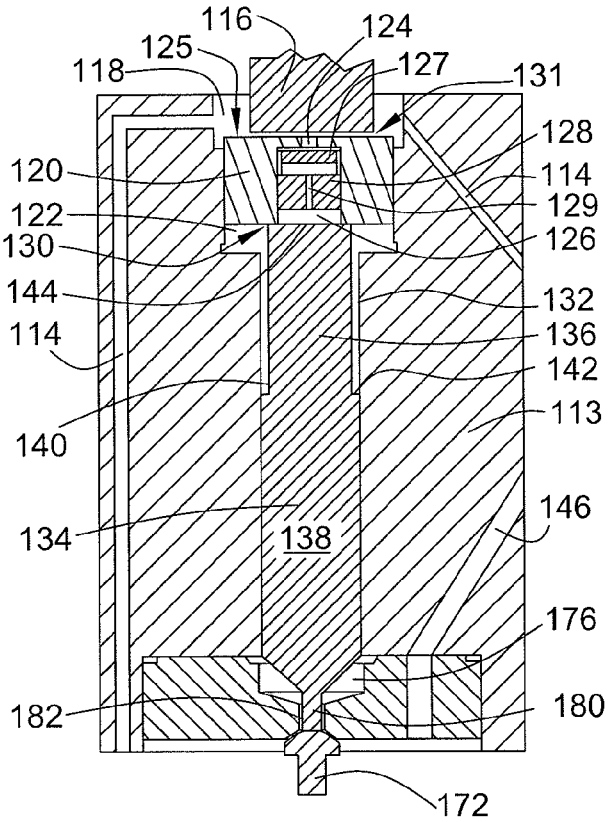

A cross section of a fuel injector 100 in accordance with one embodiment of the present disclosure is shown in FIG. 1, and a cross section detail thereof is shown in FIG. 2. The fuel injector 100 includes a piezoelectric actuator 102, which comprises a stack of piezoelectric elements 104 enclosed within a cage 106 and disposed between spacers 108. Although a particular arrangement is presented for the actuator 102 in the figures for illustration, any other known arrangement for a piezoelectric actuator is contemplated. An electrical connector 110 is connected to the injector 100 and includes electrical conduits (not shown) that are associated with the stack of piezoelectric elements 104 and arranged to provide electrical voltage and/or current thereto when a harness connector (not shown) carrying electrical signals for actuating the injector 100 is connected to the connector 110.

The cage 106 and actuator 102 are disposed within a cooling cavity 112 defined in a body 113 of the injector 100. The cavity 112 is part of a path 114 that provides fuel at a low pressure for convectively cooling the actuator 102. The body 113 of the injector 100 in the illustrated embodiment is made of various housing portions that are connected to one another, although other arrangements may be used. At one end, the cage 106 defines a post 116 that is axially displaceable by activation of the actuator 102. More specifically, activation of the actuator 102 is arranged to cause an extension of the post 116. When the actuator is deactivated, a resilient actuator compression force provided by the cage 106 is arranged to retract the post 116 toward the actuator 102. The post 116 is disposed within a post cavity 118 that is part of the cooling fuel path 114 and into which fuel at a low pressure may be present.

The end of the post 116 abuts a low pressure side of an intensifier piston 120. The intensifier piston 120 is slidably and generally sealably disposed within an intensifier bore 122 defined within the body 113 of the injector 100. Axial displacement of the post 116 is arranged to cause a corresponding axial displacement of the intensifier piston 120 within the bore 122 during operation. As best shown in FIG. 2, the intensifier piston 120 includes an inlet opening 124 at its low pressure side face 125, which is fluidly connected to a central bore 126 formed within the intensifier piston 120. A check valve arrangement 127 is disposed within the central bore 126 adjacent the opening 124. A block 128 forming an orifice passage 129 is disposed within the central bore 126 adjacent the check valve arrangement 127 and opposite the opening 124.

In the illustrated embodiment, the check valve arrangement 127 operates to permit a controlled amount of fuel to pass through the opening 124 and fill the intensifier bore 122 via the orifice passage 129 and the central bore 126. The check valve arrangement 127 further operates to fluidly obstruct the passage of fluid through the opening 124 when fluid pressure within the intensifier bore begins to increase. As the actuator 102 is activated, the intensifier piston 120 begins to move away from the actuator 102 within the intensifier bore 122. The function of the check valve arrangement 127 provides the fluid isolation of the intensifier bore 122, which has been previously filled with incompressible fluid.

The intensifier bore 122 is fluidly connected to an amplification bore 132 that is formed within the body 113 of the injector 100. In the illustrated embodiment, the intensifier and amplification bores 122 and 132 are formed adjacent one another and together form a generally cylindrical stepped bore. As is shown in FIG. 2, the intensifier bore 122 has a larger cross section diameter than the amplification bore 132. Thus, any displacement of fluid within the intensifier bore 122 along the axial direction will cause, in the axial direction, an amplified displacement of fluid in the amplification bore 132 that will displace an amplification piston 134 disposed therein.

The amplification piston 134 is slidably and generally sealably disposed within the amplification bore 132 such that fluid displacement therewithin causes motion of the amplification piston 134. Although the arrangement including the bores 122 and 132 and the pistons 120 and is a type of hydraulic amplifier, it further includes a mechanical coupling that is capable of at times, pushing the amplification piston 134 by physical contact rather than by hydraulic force. More specifically, a mechanical coupling 136 is connected to one end of the amplification piston 134 and is disposed generally between the intensifier and amplification pistons 120 and 134.

As is best shown in FIG. 2, in the illustrated embodiment the coupling 136 is formed as an integral part of the amplification piston 134 thus defining a mechanical linkage or pin 138 having a generally cylindrical shape and a stepped diameter. The stepped diameter includes a reduced diameter portion along the length of the coupling 136 such that a generally cylindrical cavity 140 is defined between a portion of the pin 138 and the amplification bore 132. The cavity 140 extends between the intensifier bore 122 and a step surface 142, which extends between the smaller outer diameter of the coupling 136 and the larger outer diameter of the amplification piston 134. As can be appreciated, when operating in a hydraulic amplification mode, the step surface 142 presents a hydraulic surface that, when the fluid in the cavity 140 is pressurized, tends to push the pin 138 away from the actuator 102. When operating in a mechanical mode, motion of the intensifier piston 120 at the initial portion of the stroke of the actuator 102 pushes an end surface 144 of the pin 138 by physical contact along an interface 130. A mechanical force provided by the actuator 102 in this mode of operation is physically transmitted via contact between these various components and tends to push the pin 138 away from the actuator 102. In the illustrated embodiment, a gap 131 may be present between the post 116 and the intensifier piston 120 when the actuator 102 is not active. The gap 131, which may nominally be, for example, about 5 μm, is optional and may accommodate the stack up of tolerances of components of the fuel injector 100.

When the fuel injector 100 is connected to an engine (not shown) in a known fashion, fuel at a high pressure is provided to a high pressure fuel passage 146 that is defined in the body 113 and that fluidly interconnects a fuel inlet port 148 with a needle valve cavity 150 that are defined in the fuel injector 100. During operation of the engine, fuel at a high pressure, for example, 300 MPa, is provided to the needle valve cavity 150 via a fuel tube (not shown) that is connected to the fuel inlet port 148. A needle valve 152 is reciprocally disposed within the needle valve cavity 150 and has a tip 153 that engages a needle valve seat 154. The needle valve seat 154 is defined on an injector tip 156 when in a closed position. In a typical direct-injection engine application, the injector tip 156 is disposed at least partially within a power cylinder of the engine. The injector tip 156 includes one or more fuel nozzle openings 158 that are placed in fluid communication with the needle cavity 150 such that pressurized fuel may be sprayed within the power cylinder of the engine. This fluid communication is blocked when the needle valve 152 is in the closed position, such that the injection of fuel into the power cylinder may be selectively accomplished by opening or retracting the needle valve 152 within the needle valve cavity 150. During injection the tip 153 is lifted from the needle valve seat 154 and the openings 158 are exposed to the pressurized fuel present in the needle valve cavity 150.

Although alternative arrangements are possible, in the illustrated embodiment the needle valve 152 is slidably constrained relative to the body 113 and is arranged to retract toward the actuator 102 when assuming an open position. The tip 153 engages the needle valve seat 154 when in the closed position. The needle valve 152 further includes a cylindrical stem portion 160 that is slidably and sealably disposed within a stem bore 162 formed in the body 113. The clearance between the stem 160 and the stem bore 162 is effective in obstructing the transfer of high fluid pressure out of the needle valve cavity 150. The position of the needle valve 152 is biased towards a closed position by a spring 164 that is disposed between the needle valve 152 and the body 113.

The needle valve 152 further includes a closing hydraulic surface 166 disposed along its central axis and located within a control chamber 168 defined within the body 113. The control chamber 168 is in fluid communication with a valve 172 through an orifice 170. The valve 172 is biased by a spring 174 and by pressure of fluid present in the control chamber 168 towards a closed position. When in the closed position, the valve 172 fluidly isolates the control chamber 168 from a drain cavity 176 that is fluidly connected to a drain port 178 of the fuel injector 100.

As shown in FIG. 2, the pin 138 includes a finger 180 disposed at an end thereof. The finger 180 is arranged to contact the valve 172 through an opening 182. Thus, when the pin 138 is extended away from the actuator 102, the finger 180 is arranged to push the valve 172 from its closed position into an open position, which brings the control chamber 168 into fluid communication with the drain cavity 176 through the orifice 170 and the opening 182.

During operation of the injector 100, fuel at a high pressure is provided to the needle valve cavity 150 via the high pressure passage 146, and also to the control chamber 168. The pressure of the fuel in the needle valve cavity 150 imparts an opening hydraulic force tending to unseat the needle valve 152. While the needle valve 152 is closed, for example, between injection events, the opening hydraulic force is countered and is generally less than a sum of closing forces acting on the needle valve 152. In the illustrated embodiment, the closing forces acting on the needle valve 152 include the bias force provided by the spring 164 and a closing hydraulic force provided by the high pressure fluid in the control chamber 168, which acts on the closing hydraulic surface 166 of the needle valve 152 in a closing direction.

When an injection event occurs, an appropriate electrical signal is provided to the actuator 102. While the electrical signal is present, the piezoelectric element 104 extends, thus pushing the post 116 against the intensifier piston 120. Under the force of the actuator 102, the intensifier piston 120 pushes against the surface 144 of the pin 138 as both components are urged to move deeper into the intensifier bore 122. When the control valve 172 is closed, fluid at a high or at injection pressure is present in the control chamber 168, which creates a hydraulic force tending to maintain the control valve 172 in the closed position. This hydraulic force is augmented by the closing force provided by the spring 174. Thus, when opening the control valve 172, an opening force provided to the pin 138 must be sufficient to overcome the combined hydraulic force and spring force that oppose the opening of the control valve 172. When the control valve 172 is opened, the control chamber 168 is fluidly connected to the drain cavity 176 such that fuel from the control chamber 168 can drain out of the drain port 178.

As can be appreciated, the force required to crack open the control valve 172 against, primarily, the fluid pressure in the control chamber 168 is greater than the force required to increase the opening of the control valve 172 and expedite the draining of fluid from the control chamber 168 to the drain cavity 176. As fluid is drained from the control chamber 168, the hydraulic force acting on the closing hydraulic surface 166 of the needle valve 152 decreases, which in turn permits opening of the needle valve 152 that enables injection of fuel through the nozzle openings 158. When terminating the injection of fuel, the actuator 102 is deactivated and the post 116 is retracted. The flow and pressure of fluid draining through the control chamber 168 and the spring 174 cause the control valve 172 to close such that fluid at the injection pressure can once again occupy the control chamber 168 and apply a closing force on the hydraulic surface 166. In this way, the needle valve 152 is urged to close, while the pin 138 and intensifier piston 120, which are in contact with the control valve 172, are pushed back toward the actuator 102.

Following activation of the actuator 102, the ability of the fuel injector 100 to initiate injection of fuel expeditiously and to attain a rated flow of fuel through the nozzle openings 158 are generally desirable. In the illustrated embodiments, the physical contact between the post 116, the intensifier piston 120, the pin 138, and the control valve 172 ensures that the full force of the actuator 102 is immediately available to push the control valve open. As the control valve 172 begins to open and move away from the actuator 102, the pressure pushing against the control valve 172 from the control chamber 168 begins to drop as fluid from the control chamber 168 begins draining into the drain cavity 176. At the same time, the motion of the control valve 172 away from the actuator 102 causes the pin 138 and the intensifier piston 120 begin to move deeper into the intensifier bore 122 as they push the control valve 172 to open.

Figure 4:
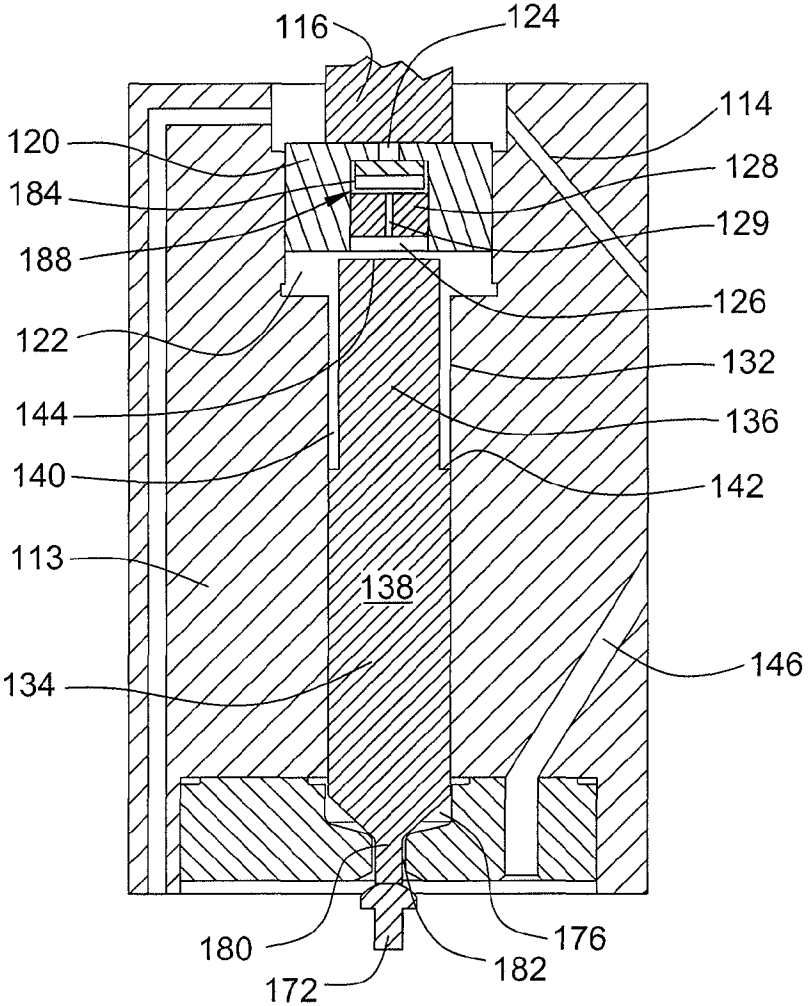
FIGS. 3 and 4 are detail cross section of a coupling in accordance with the disclosure, which is shown in two operating positions.
Figure 3:
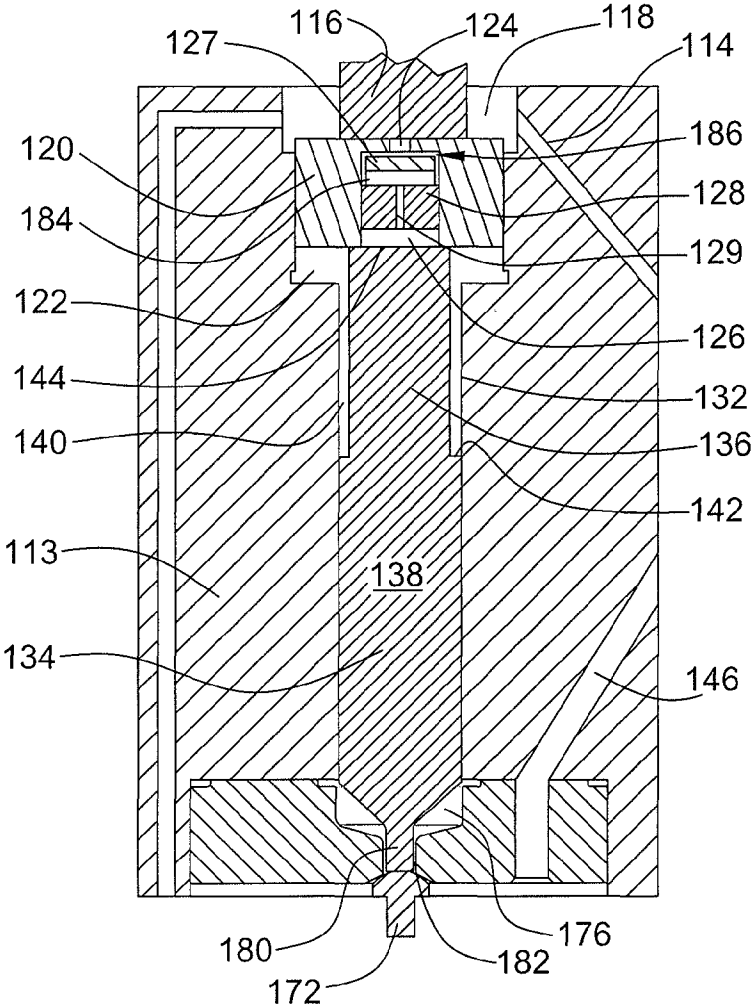

FIGS. 3 and 4 are detail cross sections of the fuel injector 100, which show the pin 138 in its at rest position when the control valve 172 is closed (FIG. 3), and also in its partially open position (FIG. 4) at which the control valve 172 has partially opened. The motion of the intensifier piston 120 into the intensifier bore 122, which has become fluidly sealed as previously discussed, causes displacement of the incompressible fluid found therein out from the intensifier bore 122. The displaced fluid is thus urged, in the illustrated embodiment, into the cylindrical cavity 140 where it pushes against the step surface 142 of the pin 138 causing the pin 138 to displace. At the same time, the fluid displacement and pressure within the intensifier bore 122 acts on the end surface 144 of the pin 138 and provides an additional hydraulic force that urges the pin 138 to move.

The displacement of the intensifier piston 120 is amplified by a factor that is proportionate to the ratio of cross sectional area between the intensifier bore 122 and the amplification bore 132. As can be appreciated, the hydraulically amplified displacement of the pin 138 to move is greater than the physical displacement of the intensifier piston 120, such that the physical contact between the intensifier piston 120 and the surface 144 of the pin 138 is lost, as shown in FIG. 4, shortly following the opening of the control valve 172 or, stated differently, shortly following the initiation of motion of the pin 138.

The hydraulically amplified displacement of the pin 138 relative to the displacement of the post 116 of the actuator 102 operates to increase the speed and distance of the opening stroke of the pin 138. In one embodiment, for example, a stroke of 70 μm can be imparted on the pin 138 in the same time as a stroke of about 40 μm can be achieved by the post 116 of the actuator 102. This accelerated and increased stroke of the pin 138, as applied to the opening of the control valve 172, is advantageous in accelerating the reduction in fluid pressure and draining of the control chamber 168, which in turn advantageously accelerates the opening and increases the extent of opening of the needle valve 152.

The hydraulically assisted mechanical coupling arrangement disclosed herein advantageously exploits the high opening force of the actuator 102 by providing a mechanical connection that transfers that force directly to the control valve 172. The force required to open the control valve 172 is initially high as it counteracts the hydraulic force in the control chamber 168 that opposes the opening, but is reduced after the fluid connection between the control chamber 168 and the drain cavity 176 has been established. During this time, it is desired to reduce the pressure drop across the control valve 172 to accelerate drainage by increasing the extent of control valve opening. In this condition, the force required to push the control valve 172 is reduced relative to the force required initially to open the control valve 172. Thus, the hydraulically assisted mechanical coupling arrangement disclosed herein exploits the hydraulically amplified displacement of the actuator 102 to accelerate the rate and extent of opening of the control valve 172 such that the rate of fuel injection of the fuel injector 100 is maximized in a short time period following activation of the actuator.

In the embodiment shown in FIGS. 3 and 4, a check valve element 184 is shown that is disposed in the central bore 126 of the intensifier piston 120. The check valve element 184 is free to move axially relative to the central bore 126 to a limited extent. During operation, when the actuator 102 is inactive, the check valve element 184 is disposed in contact with the block 128 such that a small gap 186 is formed adjacent the inlet opening 124. The gap 186 is arranged to provide fluid communication between the intensifier bore 122 and the cooling fuel path 114 to ensure that the intensifier bore 122 is maintained full of fluid. When the actuator 102 is activated and the intensifier piston 120 begins to move, as previously discussed, the pressure increase within the intensifier piston 120 causes fluid to at least temporarily surge past the check valve element 184 as it exits from the inlet opening 124. The pressure and flow momentum of the fluid surging past the check valve element 184 causes it to move within the central bore 126 and to assume a position blocking the inlet opening 124, thus providing a check valve function. Thereafter, the increased pressure of fluid within the intensifier bore 122 relative to the low pressure present in the cooling fuel path 114 maintains the check valve element 184 in position to block the inlet opening 124, thus creating a gap 188 between the block 128 and the check valve element 184.

Figure 5:
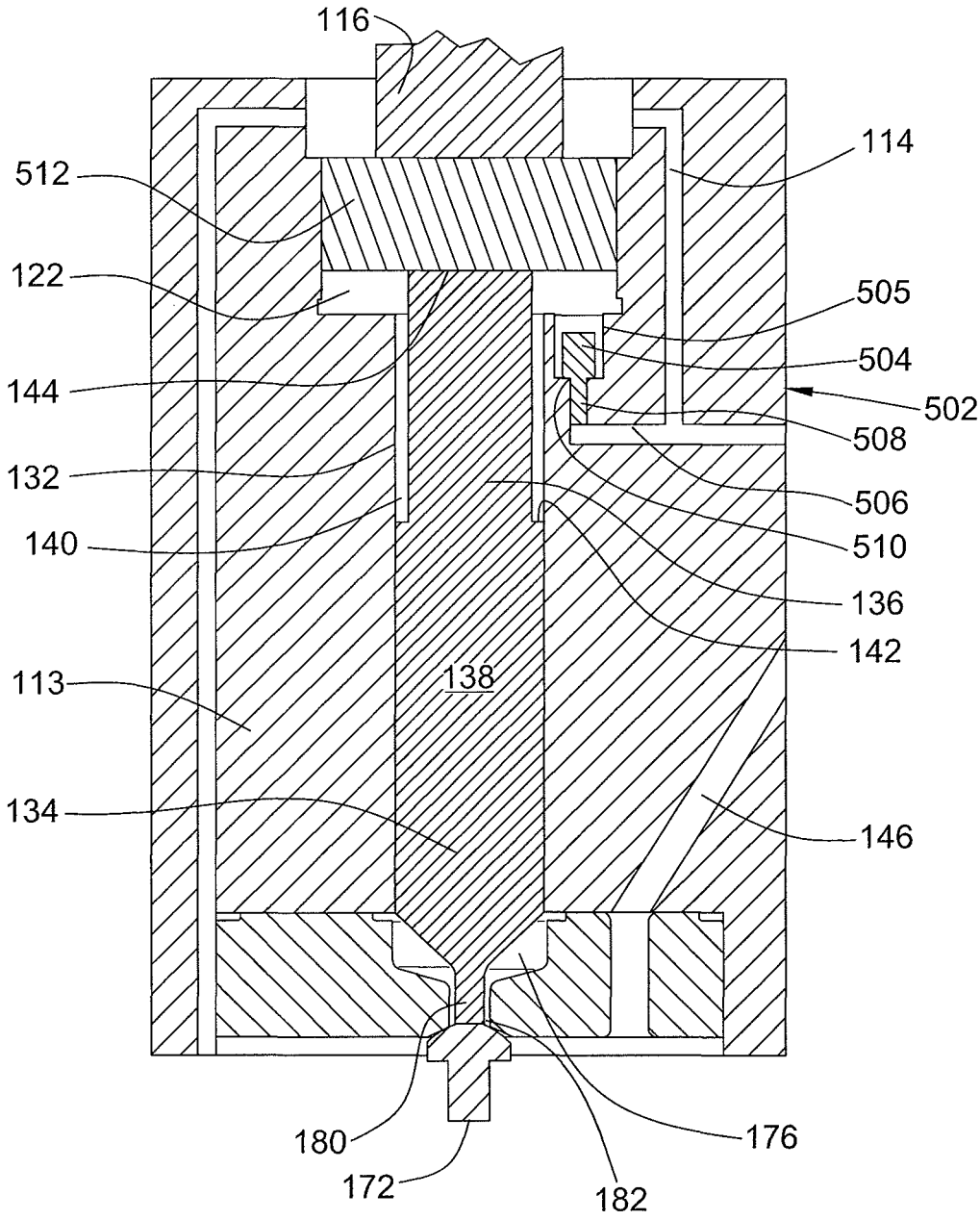
FIG. 5 is a detail cross section of an alternate embodiment of a coupling in accordance with the disclosure.

A detail cross section of an alternative embodiment of the injector 100 is shown in FIG. 5. In this embodiment, a check valve arrangement 502 is integrated with the body 113 of the injector 100 rather than being integrated with the intensifier piston 120 (FIG. 2) as previously described. In the description that follows, structures or elements already described that are the same or similar to corresponding structures or elements in the embodiments that follow are denoted by the same reference numerals as previously used for simplicity. Accordingly, in this embodiment, a check valve element 504 is reciprocally disposed within a chamber 505 that is part of a passage 506 that fluidly interconnects the cooling fuel path 114 with the intensifier bore 122. The check valve element 504 includes a stem 508 that is arranged to reciprocate within a portion of the chamber 505.

During operation, the check valve element 504 may be lifted by a flow of fluid from the passage 506 that fills the intensifier bore 122. Subsequently, during pressurization of the intensifier bore 122, the pressure of fluid in the intensifier bore 122 urges the check valve element 504 against a seat 510 such that the intensifier bore 122 may be fluidly sealed and fluidly isolated from the passage 506. It is noted that in the illustrated embodiment, the integration of the check valve element 504 with the body 113 of the injector 100 enables a simplification of the intensifier piston 512, which in this embodiment is a solid cylindrical element that does not include the central bore 126 (FIG. 2) or any of the components found therein. It is further noted that a clearance between portions of the check valve element 504 and the chamber 505 may be optionally arranged to provide an equivalent flow orifice that can meter the flow rate of fluid entering the intensifier bore 122.

Figure 7:
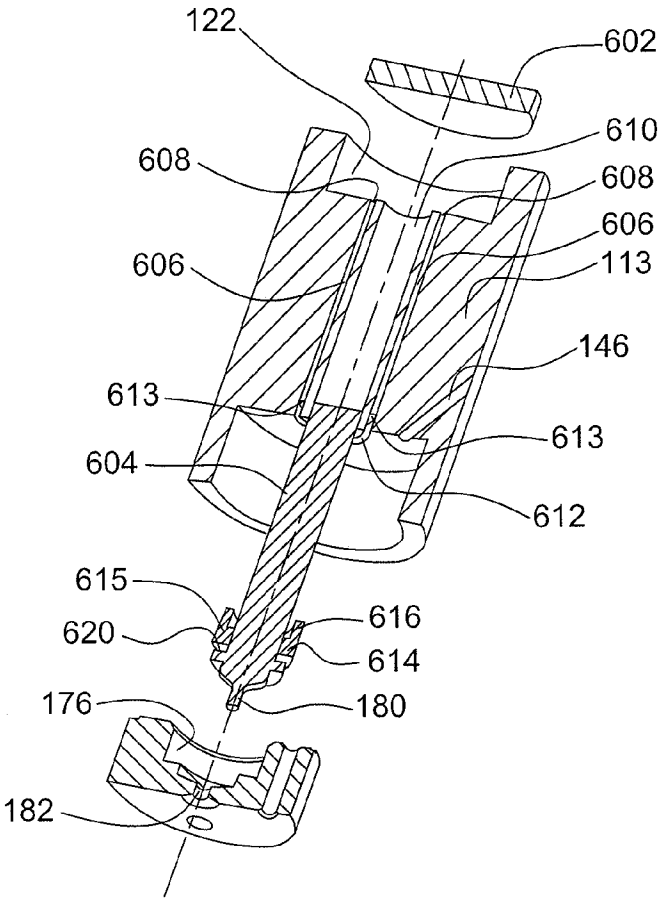
FIG. 7 is a partial exploded view in cross section of the coupling shown in FIG. 6.
Figure 6:
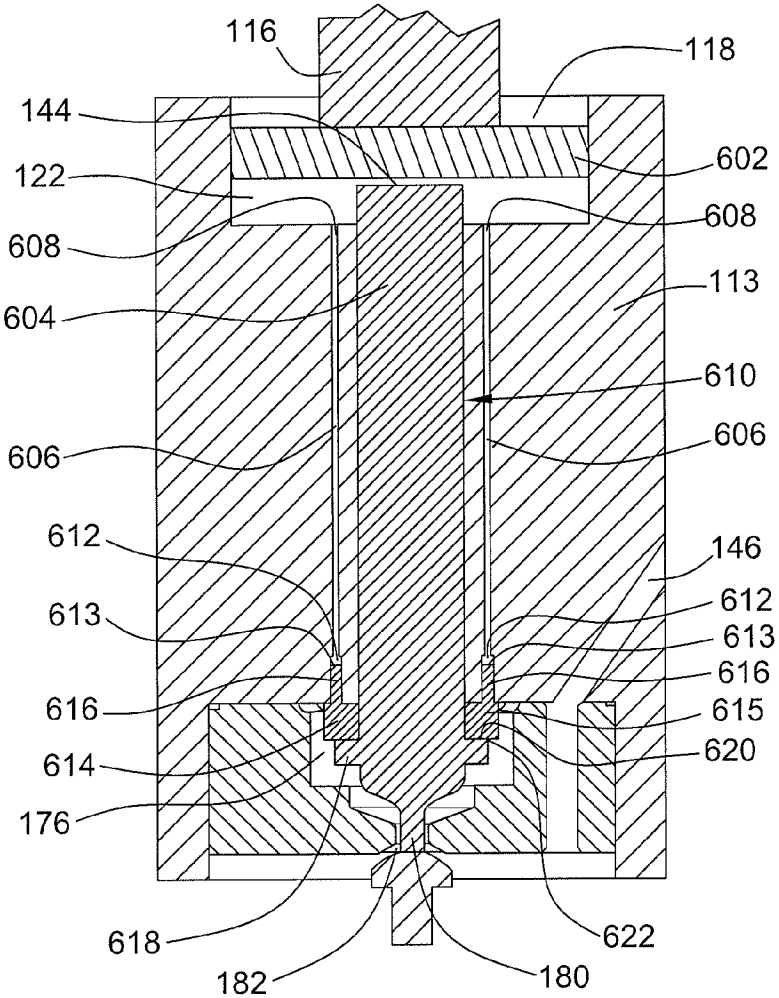
FIG. 6 is a detail cross section of another alternate embodiment of a coupling in accordance with the disclosure.

Two detail cross sections of another alternative embodiment of the injector 100 (FIG. 1) are shown in FIGS. 6 and 7, where FIG. 7 is shown in exploded view. In this embodiment, an alternative arrangement for the structures participating in the hydraulic amplification function is shown and described, while the mechanical coupling arrangement is similar to that of the previous embodiments. Accordingly, the intensifier piston 602 is in contact with the end surface 144 of a pin 604 such that a force provided by the post 116 of the actuator 102 (FIG. 1) may be physically transmitted to the pin 604 via the intensifier piston 602, as previously described.

Similar to the previously described embodiments, the intensifier piston 602 has a generally cylindrical shape and is sealably and slidably disposed within the intensifier bore 122. When the intensifier piston 602 is displaced into the bore 122 by the actuator 102 (FIG. 1), the displaced fluid enters one or more longitudinally extending shafts 606, each of which is fluidly connected with the intensifier bore 122 via a respective opening 608. Although two shafts 606 are shown in FIGS. 6 and 7, a single shaft or more than two shafts may be used.

In the illustrated embodiment, each of the shafts 606 has a generally cylindrical shape and extends parallel to a pin bore 610 that slidably and generally sealably accommodates the pin 604. The shafts 606 extend through a portion of the body 113 of the fuel injector 100 between the intensifier bore 122 and a collector volume or channel 612, which extends peripherally around the pin bore 610 adjacent the drain cavity 176. The channel 612 is fluidly interconnected with the shafts 606 via corresponding openings 613 that are defined at the end of each shaft 606.

A collar 614 disposed between the end of the pin 604 and the channel 612 includes a ring 615 that is disposed around a portion of the pin 604. An annular wall 616 is connected on one side of the ring 615 that faces the channel 612 and extends longitudinally away from the ring 615. The annular wall 616 has a generally hollow cylindrical shape having a wall thickness that is arranged to slidably and generally sealably engage the side walls of the channel 612. When the pin 604 is retracted within the pin bore 610, the collar 614 is axially retained on the pin 604 by a ledge 618 that extends at least partially around the periphery of a cross section of the pin 604 and spans in a radially outward direction relative to the pin 604. The ledge 618 defines a flat annular surface 620 that abuts a surface 622 of the ring 615. Although the collar 614 is shown as a separate component, it may alternatively be formed integrally with the pin 604.

When the pin 604 is in a retracted position relative to the pin bore 610, the annular wall 616 is disposed at least partially within the channel 612. In this way, fluid displaced by motion of the intensifier piston 602 into the intensifier bore 122, as previously described, will cause displacement of fluid out of the intensifier bore 122 and into the shafts 606 via the openings 608. Fluid and fluid pressure from the intensifier bore 122 may be communicated through the shafts 606 into the channel 612 via the openings 613. Incompressible fluid thus entering the channel 612 will push on the end of the annular wall 616 that is disposed within the channel 612. This hydraulic force applied to the end of the annular wall 616 will be transmitted through the collar 614 to the pin 604 via the ledge 618. As can be appreciated, the ratio between the aggregate cross sectional area of the pin 604 and the cross sectional area of the intensifier bore 122 will determine the extent of hydraulic amplification of the displacement of the intensifier piston 602 that may be imparted onto the pin 604.

INDUSTRIAL APPLICABILITY

The present disclosure is applicable to any device or system that includes an actuator that is arranged to push on another component, for example, a push-to-open fluid valve, in the presence of an incompressible fluid. The illustrated embodiments use fuel injectors such as those used with internal combustion engines, which use piezoelectric actuators to control the injection of fuel therefrom. In the past, the relatively limited stroke capability of piezoelectric actuators, coupled with the relatively low actuator forces provided by such actuators for longer strokes, were factors that limited their use for high fuel injection pressures. Although use of hydraulic stroke amplification arrangements was effective in increasing the stroke of the actuators, it adversely affected the operation of the injectors in that in increased injector response time.

The embodiments for a mechanical coupling having a hydraulic assist feature as provided herein are suitable for providing a high initial force and an amplified stroke. The high initial force capability is especially suited for applications requiring the opening of a fluid valve against high fluid pressure. After the fluid valve has opened against the high fluid pressure, the hydraulically assisted increase in the stroke of the actuator is arranged to quickly complete the opening of the fluid valve, which improves the response time of the system.

Figure 8:
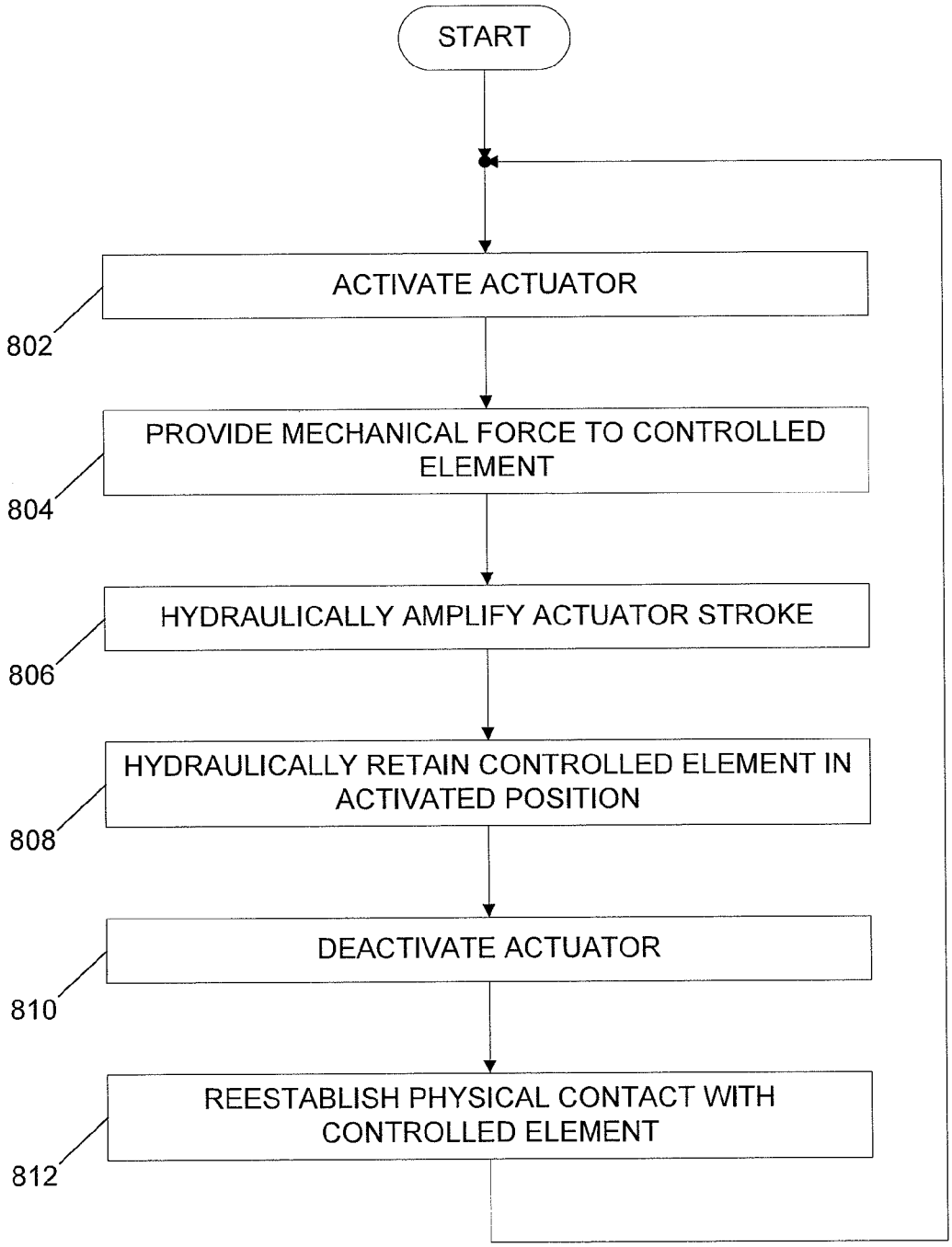
FIG. 8 is a flowchart for a method in accordance with the disclosure.

A flowchart for a method of operating a device by use of a mechanical coupling having a hydraulically assisted feature is shown in FIG. 8. The process or method disclosed below relates to the operation of a fuel injector for consistency with the theme of the embodiments disclosed above, but the specific functional attributes of the mechanical coupling having the hydraulically assisted functionality are applicable to other devices or systems. Moreover, for the sake of description, the process is described starting from a deactivated condition of an actuator and is carried through an entire activation cycle, but it should be appreciated that any of the intervening steps, especially those describing the operational steps of the disclosed coupling arrangement, may be conducted in any order regardless of the activation step of the actuator involved. In general, all methods described herein can be performed in any suitable order unless otherwise indicated herein or otherwise clearly contradicted by context.

With the foregoing in mind, the process includes activation of an actuator at 802. Activation of the actuator as used herein means that a relative extension of an arm or post of the actuator is achieved in response to an electronic or mechanical command signal, which is provided to the actuator in an appropriate fashion and causes the actuator to change its state. A mechanical force is provided to a controlled element at 804, which is transmitted between the actuator post and the controlled element by physical contact. Although other components may intervene and participate in the transmission of force between the actuator and the controlled element, the transmission of force at 804 is still accomplished by physical contact between the actuator, any intervening components, and the controlled element.

In accordance with the embodiments for a fuel injector disclosed above, for example, the actuator may be the actuator 102 (FIG. 1), and the controlled element may be the control valve 172 (FIG. 1). In this example, intervening components that can mechanically transmit the actuator force by physical contact to the control valve may include the intensifier piston and pin, which are denoted as, respectively, 120 and 138 (FIG. 2), 512 and 138 (FIG. 5), or 602 and 604 (FIG. 6), in the various disclosed embodiments.

Following the application of the mechanical force at 804, the stroke of the actuator is amplified by a hydraulic force that is transmitted by compression of fluid between two pistons at 806. During transmission of the hydraulic force, the physical connection between the actuator and the controlled element is lost in favor of the amplified stroke capability that results by use of a hydraulic amplification arrangement disposed to transmit and amplify the stroke of the actuator to the controlled element. In accordance with the embodiments for a fuel injector disclosed above, for example, such hydraulic amplification includes a intensifier piston disposed in a sealed intensifier bore that is in fluid communication with an amplification bore or other fluid passages. The amplification bore or other fluid passages are disposed to provide for the motion of an amplification piston that is either directly or indirectly arranged to cause motion of an element that is in contact with the controlled element. Amplification of the stroke of the actuator may be accomplished by compression or displacement of an incompressible fluid within the bores, which provides an amplified displacement of the amplification piston due to a difference in cross sectional area between the intensifier bore and the amplification bore or other fluid passages, such as the shafts 606 (FIG. 6).

When actuation of the controlled element is complete, the actuator may maintain pressurization of the hydraulic intensification arrangement, which can retain the controlled element in its activated position, for a predetermined period at 808, before the actuator is deactivated at 810. Deactivation of the actuator at 810 will cause a retraction of the actuator post, which will relieve pressurization in the hydraulic amplification arrangement. Under such conditions, the controlled element may be urged to its deactivated position, for example, by a resilient force such as a force provided by a spring. As the controlled element and any intervening components settle into their at rest positions, the mechanical or physical contact therebetween may be substantially reestablished at 812 in preparation for a subsequent activation event during which a direct mechanical force may be reapplied from the actuator to the controlled element, such as the force application at 804 following a subsequent activation of the actuator at 802.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

We claim:

1. A fuel injector for an internal combustion engine, comprising:

an injector body;

an actuator having a post disposed within the injector body, the post arranged to travel over an actuator stroke distance between an extended stroke position when the actuator is in an activated condition and a retracted stroke position when the actuator is in a deactivated condition;

a control valve disposed within the injector body and being displaceable to an open position from a closed position when an opening force is applied to the control valve;

a transmission arrangement disposed in the injector body between the post and the control valve, the transmission arrangement comprising:

an intensifier bore defined in the injector body;

an intensifier piston slidably disposed within the intensifier bore and arranged to physically contact the post when the post moves towards the extended stroke position;

a pin slidably disposed within a pin bore defined in the injector body, the pin being in contact with the intensifier piston and having a finger in contact with the control valve;

wherein the actuator force from the post is mechanically transmitted to the control valve via the intensifier piston, the pin, and the finger;

and wherein the transmission arrangement is arranged to mechanically transmit by physical contact an actuator force from the post to the control valve when the post begins to travel towards the extended stroke position, and hydraulically amplify the actuator stroke between the post and the control valve as the post continues to travel from the retracted stroke position to the extended stroke position.

2. The fuel injector of claim 1, further including:

an amplification bore fluidly connected to the intensifier bore, wherein the intensifier and amplification bores are full of an incompressible fluid; and an amplification piston slidably disposed in the amplification bore and associated with the pin;

wherein a displacement of the intensifier piston within the intensifier bore when the post travels from the retracted stroke position to the extended stroke position causes a corresponding displacement of the incompressible fluid out from the intensifier bore and into the amplification bore, and wherein incompressible fluid thus displaced pushes the amplification piston and causes a displacement of the pin.

3. The fuel injector of claim 1, wherein the pin has a generally stepped cylindrical shape, the fuel injector further including:

an amplification piston portion defined on the pin and disposed axially adjacent the finger, the amplification piston portion having an outer diameter that slidably engages the pin bore;

a coupling portion defined on the pin and disposed in abutting relationship with the intensifier piston, the coupling portion having a reduced outer diameter that is smaller than the outer diameter of the amplification piston portion;

a stepped surface is defined on the pin between the amplification piston portion and the coupling portion; and a generally cylindrical cavity defined between the coupling, the pin bore, and the step surface;

wherein a displacement of the intensifier piston within the intensifier bore when the post travels from the retracted stroke position to the extended stroke position causes a corresponding displacement of the incompressible fluid out from the intensifier bore and into the generally cylindrical cavity, and wherein incompressible fluid thus displaced yields a hydraulic force that pushes the stepped surface and causes a displacement of the pin.

4. The fuel injector of claim 1, further including:

at least one fluid shaft defined in the injector body and extending alongside the pin bore, the at least one fluid shaft being in fluid communication with the intensifier bore;

an annular channel formed around a portion of the pin bore than is adjacent the finger, the annular channel being in fluid communication with the at least one fluid shaft;

a collar engaged around a portion of the pin adjacent the finger, the collar including an annular wall slidably and sealably disposed at least partially within the annular channel;

wherein a displacement of the intensifier piston within the intensifier bore when the post travels from the retracted stroke position to the extended stroke position causes a corresponding displacement of the incompressible fluid out from the intensifier bore and into the at least one fluid shaft, and wherein incompressible fluid thus displaced pushes the annular wall of the collar and causes a displacement of the pin.

5. The fuel injector of claim 1, further including a check valve arrangement fluidly interconnected between the intensifier bore and a fluid passage defined in the fuel injector and capable of providing incompressible fluid to fill the intensifier bore.

6. A transmission arrangement for transmitting a force between an actuator and a control valve, the actuator and the control valve being parts of a component, the component comprising:

a component body;

a post associated with the actuator and disposed within the component body, the post arranged to travel over an actuator stroke between an extended stroke position when the actuator is in an activated condition and a retracted stroke position when the actuator is in a deactivated condition;

an intensifier bore defined in the component body adjacent the post of the actuator;

an intensifier piston slidably disposed within the intensifier bore and arranged to physically contact the post when the post moves towards the extended stroke position;

a pin slidably disposed within a pin bore defined in the component body, the pin being in contact with the intensifier piston and having a finger in contact with the control valve;

wherein the actuator force from the post is mechanically transmitted to the control valve via the intensifier piston, the pin, and the finger;

wherein the control valve is displaceable to an open position from a closed position when an opening force is applied to the control valve that is greater than a closing force provided to the control valve; and wherein the transmission arrangement is disposed in the component body between the post and the control valve, the transmission arrangement being arranged to mechanically transmit by physical contact an actuator force from the post to the control valve when the post begins to travel towards the extended stroke position, and hydraulically amplify the actuator stroke between the post and the control valve when the post travels from the retracted stroke position to the extended stroke position.

7. The transmission arrangement of claim 6, wherein the component is a fuel injector for an internal combustion engine.

8. The transmission arrangement of claim 6, further including:

an amplification bore fluidly connected to the intensifier bore, wherein the intensifier and amplification bores are full of an incompressible fluid; and an amplification piston slidably disposed in the amplification bore and associated with the pin;

wherein a displacement of the intensifier piston within the intensifier bore when the post travels from the retracted stroke position to the extended stroke position causes a corresponding displacement of the incompressible fluid out from the intensifier bore and into the amplification bore, and wherein incompressible fluid thus displaced pushes the amplification piston and causes a displacement of the pin.

9. The transmission arrangement of claim 6, wherein the pin has a generally stepped cylindrical shape, the transmission arrangement further including:

an amplification piston portion defined on the pin and disposed axially adjacent the finger, the amplification piston portion having an outer diameter that slidably engages the pin bore;

a coupling portion defined on the pin and disposed in abutting relationship with the intensifier piston, the coupling portion having a reduced outer diameter that is smaller than the outer diameter of the amplification piston portion;

a stepped surface defined on the pin between the amplification piston portion and the coupling portion; and a generally cylindrical cavity defined between the coupling, the pin bore, and the step surface;

wherein a displacement of the intensifier piston within the intensifier bore when the post travels from the retracted stroke position to the extended stroke position causes a corresponding displacement of the incompressible fluid out from the intensifier bore and into the generally cylindrical cavity, and wherein incompressible fluid thus displaced yields a hydraulic force that pushes the stepped surface and causes a displacement of the pin.

10. The transmission arrangement of claim 6, further including:

at least one fluid shaft defined in the component and extending alongside the pin bore, the at least one fluid shaft being in fluid communication with the intensifier bore;

an annular channel formed around a portion of the pin bore than is adjacent the finger, the annular channel being in fluid communication with the at least one fluid shaft;

a collar engaged around a portion of the pin adjacent the finger, the collar including an annular wall slidably and sealably disposed at least partially within the annular channel;

wherein a displacement of the intensifier piston within the intensifier bore when the post travels from the retracted stroke position to the extended stroke position causes a corresponding displacement of the incompressible fluid out from the intensifier bore and into the at least one fluid shaft, and wherein incompressible fluid thus displaced pushes the annular wall of the collar and causes a displacement of the pin.

11. The transmission arrangement of claim 6, further including a check valve arrangement fluidly interconnected between the intensifier bore and a fluid passage defined in the component and capable of providing incompressible fluid to fill the intensifier bore.

12. A method of operating a device by use of a mechanical coupling having a hydraulically assisted feature, comprising:

activating an actuator included in a component, the actuator being arranged to extend a post associated therewith when the actuator is active in response to a control signal, the post being extended by an actuator stroke distance between a retracted stroke position and an extended stroke position;

providing a mechanical force to a controlled element by physical contact between the actuator post and the controlled element via intervening components, the mechanical force being provided by the actuator to the post;

wherein the intervening components include:

an intensifier piston slidably disposed within an intensifier bore defined in a component body and arranged to physically contact the post when the post moves towards an extended actuator stroke position; and a pin slidably disposed within a pin bore defined in the component body, the pin being in contact with the intensifier piston and having a finger in contact with the controlled element;

wherein providing the mechanical force by physical contact includes transmitting the mechanical force from the post via the intensifier piston, the pin, and the finger; and amplifying the actuator stroke by providing a hydraulic force that is transmitted by compression of fluid within a bore between an intensifier piston and an amplification piston, the intensifier piston being in contact with the post of the actuator; and providing the amplified actuator stroke to the controlled element.

13. The method of claim 12, further including maintaining pressurization of the bore such that the controlled element may be retained in an extended position for a period of time.

14. The method of claim 12, further including retracting the post of the actuator to relieve pressurization in the bore.

15. The method of claim 14, further including providing a resilient force to the controlled element to return the controlled element to a closed position and to substantially reestablish physical contact between the post of the actuator, the intervening components, and the controlled element.

16. The method of claim 12, wherein the intervening components further include:

an amplification bore defined in the component body and fluidly connected to the intensifier bore, wherein the intensifier and amplification bores are full of an incompressible fluid; and wherein the amplification piston is slidably disposed in the amplification bore and associated with the pin;

wherein hydraulically amplifying the actuator stroke is accomplished by providing a displacement of the intensifier piston within the intensifier bore when the post travels from a retracted actuator stroke position to the extended actuator stroke position thus causing a corresponding displacement of the incompressible fluid out from the intensifier bore and into the amplification bore such that the incompressible fluid thus displaced pushes the amplification piston and causes a displacement of the pin.

17. The method of claim 12, wherein the intervening components further include:

an amplification piston portion defined on the pin and disposed axially adjacent the finger, the amplification piston portion having an outer diameter that slidably engages the pin bore defined in the component body;

a coupling portion defined on the pin and disposed in abutting relationship with the intensifier piston, the coupling portion having a reduced outer diameter that is smaller than the outer diameter of the amplification piston portion;

a stepped surface is defined on the pin between the amplification piston and coupling portions; and a generally cylindrical cavity defined between the coupling, the pin bore, and the step surface;

wherein hydraulically amplifying the actuator stroke is accomplished by providing a displacement of the intensifier piston within the intensifier bore when the post travels from a retracted actuator stroke position to the extended actuator stroke position thus causing a corresponding displacement of the incompressible fluid out from the intensifier bore and into the generally cylindrical cavity such that the incompressible fluid thus displaced yields a hydraulic force that pushes the stepped surface and causes a displacement of the pin.

* * * * *